United States Patent [19]

Kurbanov et al.

[11] Patent Number: 4,893,860

[45] Date of Patent: Jan. 16, 1990

[54] DEVICE FOR GRIPPING AND SUSPENDING DRILL PIPE STAND

[75] Inventors: Nariman G. K. O. Kurbanov; Vagif A. Ali-Zade; Vladimir A. Kartashev; Eldar T. O. Zeinalov, all of Baku, U.S.S.R.

[73] Assignee: Azerbaidjansky Nauchno-Issledovatelsky I Proektno-Konstruktorsky Institut Neftyanogo Mashino-Stroeniya, Baku, U.S.S.R.

[21] Appl. No.: 213,625

[22] Filed: Jun. 30, 1988

[51] Int. Cl.[4] ..... B66C 1/44

[52] U.S. Cl. ..... 294/114; 294/91; 294/117

[58] Field of Search ..... 294/91, 101, 102.2, 294/106, 112–114, 117

[56] References Cited

U.S. PATENT DOCUMENTS

| | | | |
|---|---|---|---|
| 673,679 | 5/1901 | Foster et al. | 294/114 |
| 910,062 | 1/1909 | Holmberg | 294/113 |
| 1,223,960 | 4/1917 | Gilmartin | 294/114 |
| 1,396,317 | 11/1921 | Boyter | 294/114 X |
| 1,548,265 | 8/1925 | Hall | 294/91 X |
| 1,963,693 | 6/1934 | Cole et al. | 294/113 X |
| 2,300,980 | 11/1942 | Sinclair | 294/114 |
| 2,328,167 | 8/1943 | Ratigan | 294/91 X |

FOREIGN PATENT DOCUMENTS

| | | | |
|---|---|---|---|
| 15679 | 6/1930 | U.S.S.R. . | |
| 256685 | 4/1970 | U.S.S.R. . | |
| 787337 | 12/1980 | U.S.S.R. | 294/114 |

*Primary Examiner*—Johnny D. Cherry

*Attorney, Agent, or Firm*—Fleit, Jacobson, Cohn, Price, Holman & Stern

[57] ABSTRACT

According to the invention, the device comprises clamping elements hinged in a housing provided with a cut-out and a control system formed by a group of levers which are connected with a hoisting line. Besides, one of the levers is hinged to the housing and the other levers, to the clamping elements.

3 Claims, 4 Drawing Sheets

DEVICE FOR GRIPPING AND SUSPENDING DRILL PIPE STAND

FIELD OF THE INVENTION

The present invention relates to equipment for oil and gas production, and more particularly it relates to devices for gripping and suspending a drill pipe stand.

The invention can find most effective application in working platforms of rigs for drilling and servicing wells using vertical stacking of pipes and rods.

BACKGROUND OF THE INVENTION

When making round trips with pipes and rods using their vertical stacking in rigs for drilling and servicing wells, it is necessary to readjust said rigs to suit the length of pipes and rods run into the well according to the National Standard of each particular country. That is why to ensure that round trips are made properly, derrickmen have to see to it that the working platform of the rig is positioned according to the length of pipes and rods at an appropriate level above the rig floor. Besides, while replacing rejected drill pipe stands with new ones, they have to be brought from the vertical to horizontal position and then back, which involves changes of appropriate tools and results in lost production time. Thus, cutting down nonproductive time is the main prerequisite for higher efficiency of pipe and rod trips.

There is known a device for handling and stacking drill pipes (SU, A, 256,685), which comprises a grip with slips and toothed blocks positioned in a housing with provision for moving vertically along the guides by means of a lifting mechanism. The grip housing is fitted to a boom which travels horizontally by dint of two bogies, each of said bogies being provided with an electric motor and a control system. The grip housing is provided with a follow mechanism, a lock, and a wedge-shaped head-piece to ensure that a drill pipe is adequately gripped.

Such a construction allows handling and stacking of pipes only in stationary derricks. It cannot be used in mobile rigs for drilling and servicing wells inasmuch as it is pretty bulky, thus making impossible quick readjustment and rigging-up. Practical application of the heretofore-known technical solution considerably decreases operating efficiency of rigs and fails to comply with the requirement for mobility of mobile rigs due to their poor transportability.

There is known a device for gripping and suspending drill pipe stands (SU,A, 15,679), comprising clamping elements which are essentially two clips hinged to each other with toothed blocks rigidly fixed therein. The two blocks are hinged to control levers operated by a handle. The outer surfaces of the clips are provided with eyes to accommodate flexible pull members which are connected with a hoisting line.

This device makes it possible to grip a pipe or rod body in any portion thereof and to move it relative to the well axis. However, to grip a pipe where it is required, the clamping elements are brought to the upper end of the pipe, then the pipe is placed into the opening between the clips, and the device lowered to reach the portion of the pipe to be gripped. Since it is impossible to take hold of the pipe from the side, some additional operations are required when gripping and releasing it, which cuts down production time.

What is more, the known devices employ toothed blocks to grip a pipe or a rod which leave dents on its body.

SUMMARY OF THE INVENTION

It is an object of the present invention to simplify the design and to reduce weight and overall dimensions of the device, as well as to ensure side gripping of the drill pipe stand.

The essence of the invention resides in the fact that in a device for gripping and suspending a drill pipe stand, comprising clamping elements connected with a hoisting line by means of flexible pull members and a control system connected with the chucks, according to the invention, the clamping elements are hinged in a housing provided with a cut-out and the control system is formed by a group of levers connected with the hoisting line by means of the flexible pull members, one of said levers being hinged to the housing and the other levers, to the clamping elements.

When bringing a drill pipe stand from the vertical to horizontal position and then back, it is necessary that the device be provided with a lock which is essentially a clip fixed in the lower part of the housing and a pin positioned in the clip so that it can be brought into and out of it to cover the housing cut-out.

It is expedient that each clamping element be made as a chucking jaw positioned so as to grip a drill pipe stand when descending the housing.

The invention disclosed herein enables the use of the device for gripping and suspending a drill pipe stand in mobile rigs for drilling and servicing wells.

BRIEF DESCRIPTION OF THE DRAWINGS

Given below is a description of an exemplary embodiment of the present invention with due reference to the accompanying drawings, wherein.

DETAILED DESCRIPTION OF THE INVENTION

Figure 1:
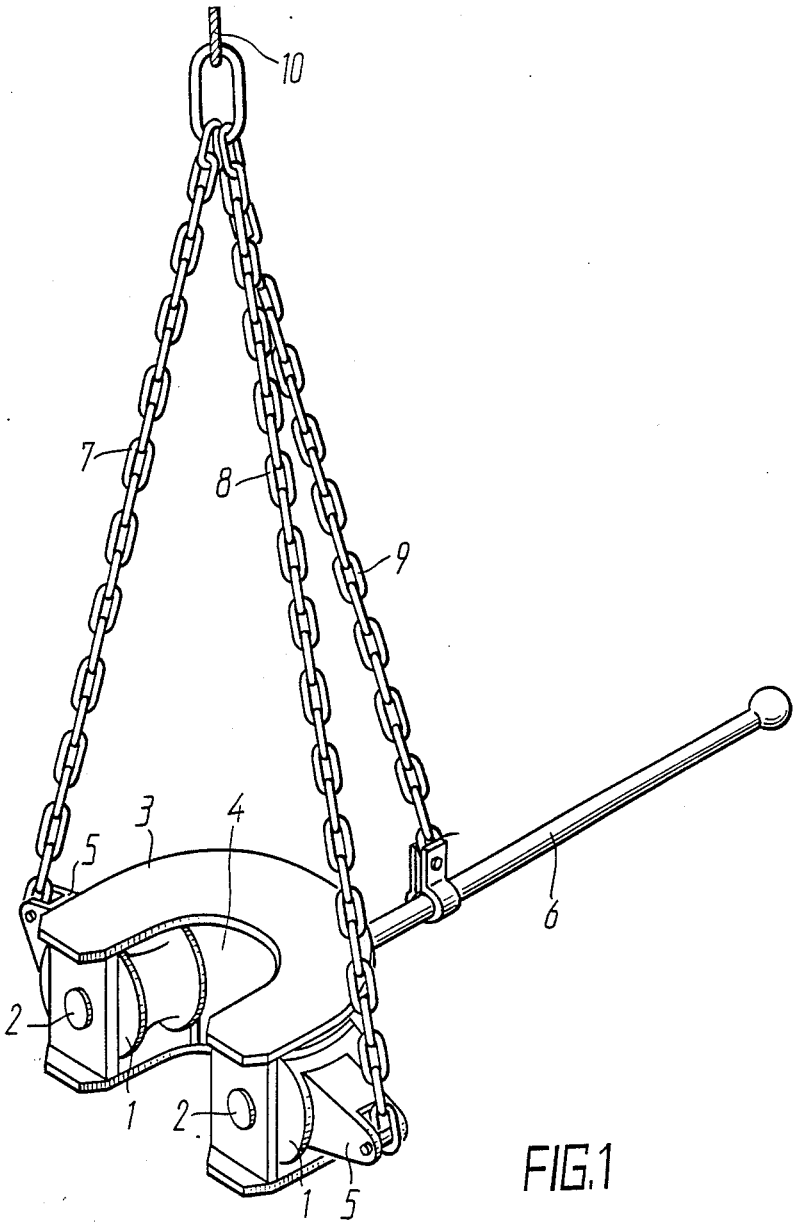
FIG. 1 is a general schematic view of a device for gripping and suspending a drill pipe stand according to the invention.

The device for gripping and suspending a drill pipe stand, according to the invention, comprises clamping elements 1 (FIG. 1) made as jaws which suit the size of a pipe gripped.

The clamping elements 1 are fitted in a housing 3 on axles 2 eccentrically therewith, the housing being provided with a cut-out 4, whereas the clamping elements are rigidly coupled to control levers 5. A control lever 6 is located in the symmetry plane of the housing 3 on that side thereof which is opposite to the cut-out 4. The levers 5 and 6 are suspended from a hoisting line 10 by flexible pull members 7,8,9.

Figure 2:
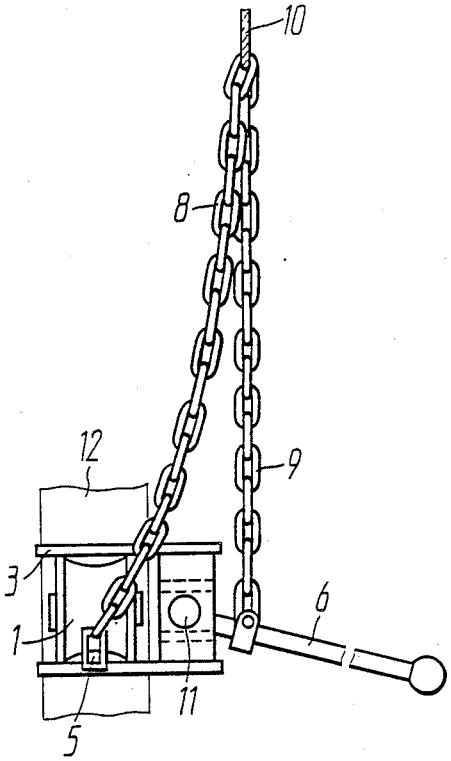
FIG. 2 is a side view of a device for gripping and suspending a drill pipe stand at a moment it is brought to the pipe according to the invention.

The lever 6 (FIG. 2) is fitted in the housing 3 on an axle 11 so that it can turn in a confined space around the housing 3 with the device brought to a portion 12 of the pipe.

Figure 3:
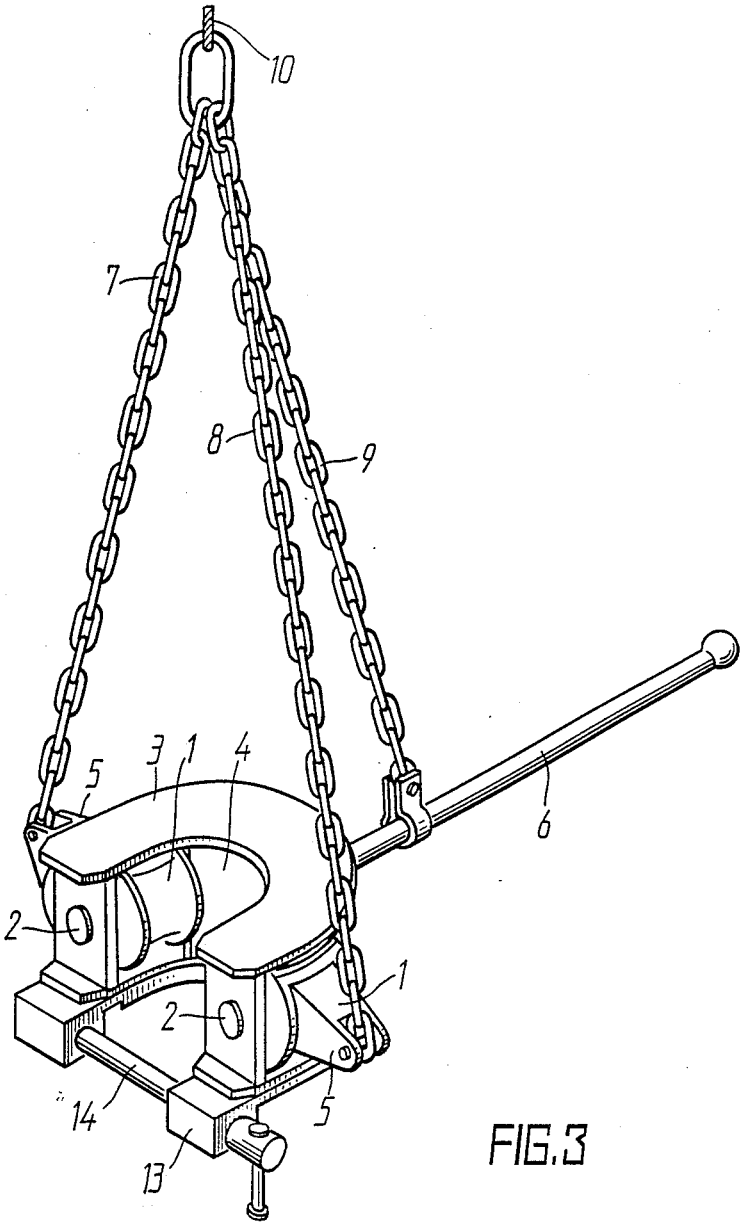
FIG. 3 is a view of a device for gripping and suspending a drill pipe stand used to bring the drill stand from the vertical to horizontal position and then back, according to the invention.

Should the need arise to bring some individual drill pipe stands from the vertical to horizontal position, the device is provided with a lock, comprising a detachable clip 13 (FIG. 3) fitted to the lower portion of the housing 3 and a pin 14 positioned so that it can be brought into and out of the clip 13.

Figure 4:
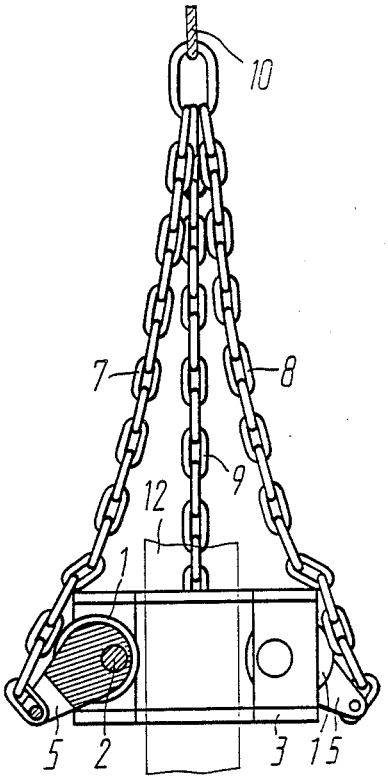
FIG. 4 is a front view of a device for gripping and suspending a drill pipe stand at a moment it is brought to the pipe according to the invention.
Figure 5:
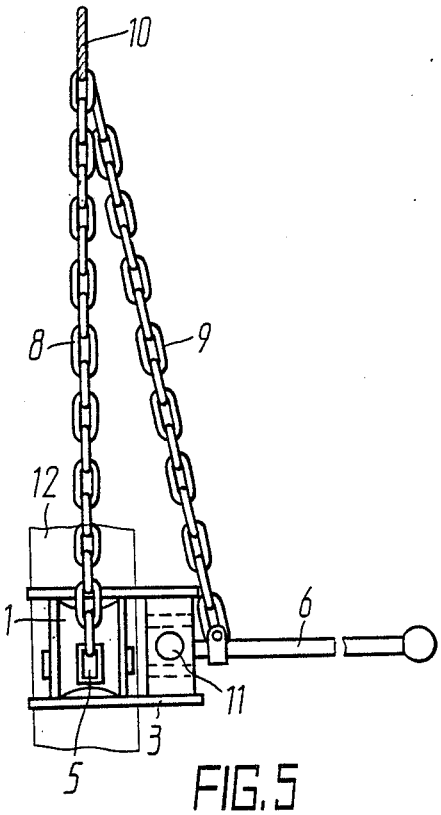
FIG. 5 is a side view of a device for gripping and suspending a drill pipe stand with the pipe gripped according to the invention.
Figure 6:
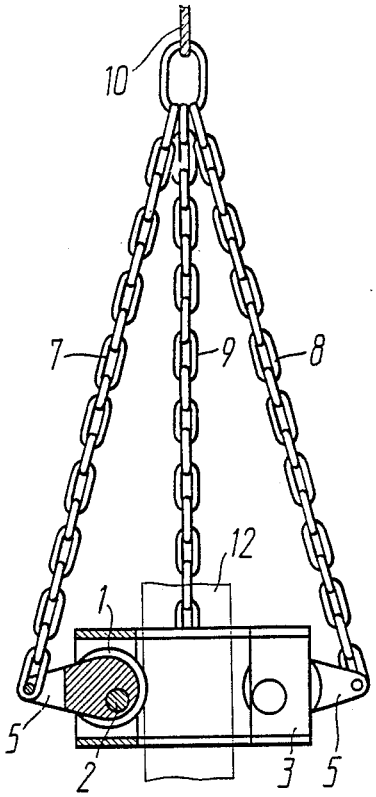
FIG. 6 is a front view of a device for gripping and suspending a drill pipe stand with the pipe gripped according to the invention.

FIGS. 4,5,6 represent the device at a moment it is brought to the portion 12 of the pipe and the device with the pipe gripped.

The device for gripping and suspending a drill pipe stand operates as follows. A derrickman staying on the working platform of the rig for drilling and servicing wells depresses the free end of the lever 6 (FIG. 2), the other side of the lever going upwards. Since this end of the lever 6 is hinged to the housing 3, the latter turns around the axle 11 through a certain angle going upwards with the lever 6 depressed. As this takes place, the whole weight load of the device is transferred to the hoisting line 10 via the stretched pull member 9. The pull members 7,8 (FIG. 4) slacken, thereby enabling the levers 5 to go downwards. The clamping elements 1 made as eccentric jaws turn around the axles 2 and while entering the housing 3, make the cut-out 4 thereof free (FIG. 1). Then the derrickman brings the device to the appropriate portion 12 of the pipe and releases the lever 6. Under the effect of the weight of the device the flexible pull members 7,8 stretch (FIGS. 5,6) and the levers 5 with the clamping elements 1 turn until the jaw surfaces come into contact with the pipe surface. Then the device is pulled up by means of the hoisting line 10 with the result that clamping elements 1 grip the pipe as they turn eccentric to the axles 2. Thus, the drill pipe stand is gripped wherever required, the weight load of the drill stand being transferred to the hoisting line 10 via the pull members 7 and 8, slackening the pull member 9. The drill stand is placed on a pipe racking board or at the wellhead (not shown), after which the hoisting line 10 is lowered. The drill pipe stand will be continuously gripped by the clamping elements 1 until its lower end is placed on the pipe racking board or into the drill pipe coupling. Once the drill pipe stand is placed in position, the pull members 7,8 (FIG. 4) slacken to release it. The release operations are performed in the same sequence as gripping.

Should some defective pipes be detected in the process of round trips, these are replaced using the lock. To accomplish this, the clip 13 (FIG. 3) is secured in the lower portion of the housing 3 with the pin 14 brought out of the clip 13. Once the drill pipe stand is gripped, the pin 14 is brought into the clip 13 and fixed in position to cover the cut-out 4 of the housing 3. Then the drill pipe stand is brought to the horizontal position as it is pulled by the lower end. Once in the horizontal position, the pin 14 is brought out of the clip 13 to open the cut-out 4 of the housing 3 and the drill pipe stand is made free. The reverse sequence of operations is observed to bring a new drill pipe stand from the horizontal to vertical position, after which the clip 13 is removed and the vertical stacking of drill pipe stands is continued.

The present invention simplifies the design of mobile rigs for drilling and servicing wells since it eliminates the need for units to move the derrickman's working platform according to the length of drill pipe stands and for adjustment of the rigs in the process of operation.

It has become possible to position the working platform at a constant level above the rig floor. The field of application for such rigs greatly widens to open up possibilities for round trips using vertical stacking of coupling-free drill pipes. The invention makes it possible to considerably save time involved in replacing individual defective pipes with new ones with drill pipe stands brought from the vertical to horizontal position and then back.

What is claimed is:

1. A Device for gripping an elongated article such as a drill pipe stand, the device comprising a yoke-shaped housing having opposed, substantially parallel arm portions each extending from a base portion of the housing, the arm portions defining a passageway therebetween for embracing the article, an eccentric gripper pivotally mounted in each arm portion about a respective pivot axis, a lever connected with each gripper for moving the gripper between a gripping position and a release position with respect to the passageway, the lever extending outwardly from the respective arm portion, a lifting member, a flexible element extending between each lever and the lifting member for suspending the housing from the lifting member with the arm portions and the pivot axes extending substantially horizontally, an elongate operating handle extending outwardly from the base portion of the housing, and a flexible member extending between the lifting member and a part of the handle located between the housing and an outer end of the handle, the device being configured for tensioning the flexible member while relaxing the flexible elements when downward pressure is applied to the outer end of the handle and for relaxing the flexible member while tensioning the flexible elements when said pressure is released, and each gripper being configured for assuming the release position when the respective flexible element is relaxed and the gripping position when the respective flexible element is tensioned.

2. A device as claimed in claim 1 wherein the handle has a pivot connection with the housing.

3. A device as claimed in claim 1 including a releasable locking pin for connection between the arm portions at respective outer ends thereof.

* * * * *